US011111701B2

(12) United States Patent
Inan et al.

(10) Patent No.: US 11,111,701 B2
(45) Date of Patent: Sep. 7, 2021

(54) MOTOR VEHICLE DOOR LOCK

(71) Applicant: Kiekert AG, Heiligenhaus (DE)

(72) Inventors: Omer Inan, Dorsten (DE); Ulrich Weichsel, Duisburg (DE); Heiko Hemmer, Essen (DE)

(73) Assignee: Kiekert AG, Heiligenhaus (DE)

( * ) Notice: Subject to any disclaimer, the term of this patent is extended or adjusted under 35 U.S.C. 154(b) by 435 days.

(21) Appl. No.: 15/313,213

(22) PCT Filed: May 21, 2015

(86) PCT No.: PCT/DE2015/100206
§ 371 (c)(1),
(2) Date: Nov. 22, 2016

(87) PCT Pub. No.: WO2015/176714
PCT Pub. Date: Nov. 26, 2015

(65) Prior Publication Data

US 2017/0138095 A1 May 18, 2017

(30) Foreign Application Priority Data

May 23, 2014 (DE) ..... 10 2014 007 525.7

(51) Int. Cl.
*E05B 79/04* (2014.01)
*E05B 85/02* (2014.01)
(Continued)

(52) U.S. Cl.
CPC ..... *E05B 79/04* (2013.01); *E05B 15/1635* (2013.01); *E05B 85/02* (2013.01);
(Continued)

(58) Field of Classification Search
CPC ..... E05B 79/04; E05B 15/1635; E05B 85/02; E05B 17/0004; E05B 2015/1664;
(Continued)

(56) References Cited

U.S. PATENT DOCUMENTS 3,868,836 A * 3/1975 La Roche ..... E05B 83/16 70/240
4,212,176 A * 7/1980 Hegedus ..... E05B 83/16 70/417
(Continued)

FOREIGN PATENT DOCUMENTS

DE 32 34 103 3/1983
DE 28 06 491 C2 6/1986
(Continued)

OTHER PUBLICATIONS

International Search Report and Written Opinion for corresponding Patent Application No. PCT/DE2015/100206 dated Sep. 28, 2015.
(Continued)

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The invention relates to a motor vehicle door lock, comprising a lock case (1) and also comprising at least one locking mechanism (2, 3) supported in the lock case (1), which locking mechanism consists essentially of a rotary latch (2) and a pawl (3). In addition, a lock housing (5) connected to the lock case (1) is realized. The lock case (1) is mostly L-shaped in the cross-section. In addition, the lock case (1) describes a locking-mechanism plane (G) and an end-plate plane (S) different from the locking-mechanism plane. The end-plate plane (S) is equipped with a bridge part (7), which spans at least one inlet opening (E), and two side parts (6). According to the invention, the lock case (1) is equipped with merely the two side parts (6) bordering the inlet opening (E), without a bridge part. In contrast, the lock housing (5) acts completely or partially as a bridge part (7).

10 Claims, 2 Drawing Sheets

Figure 1:
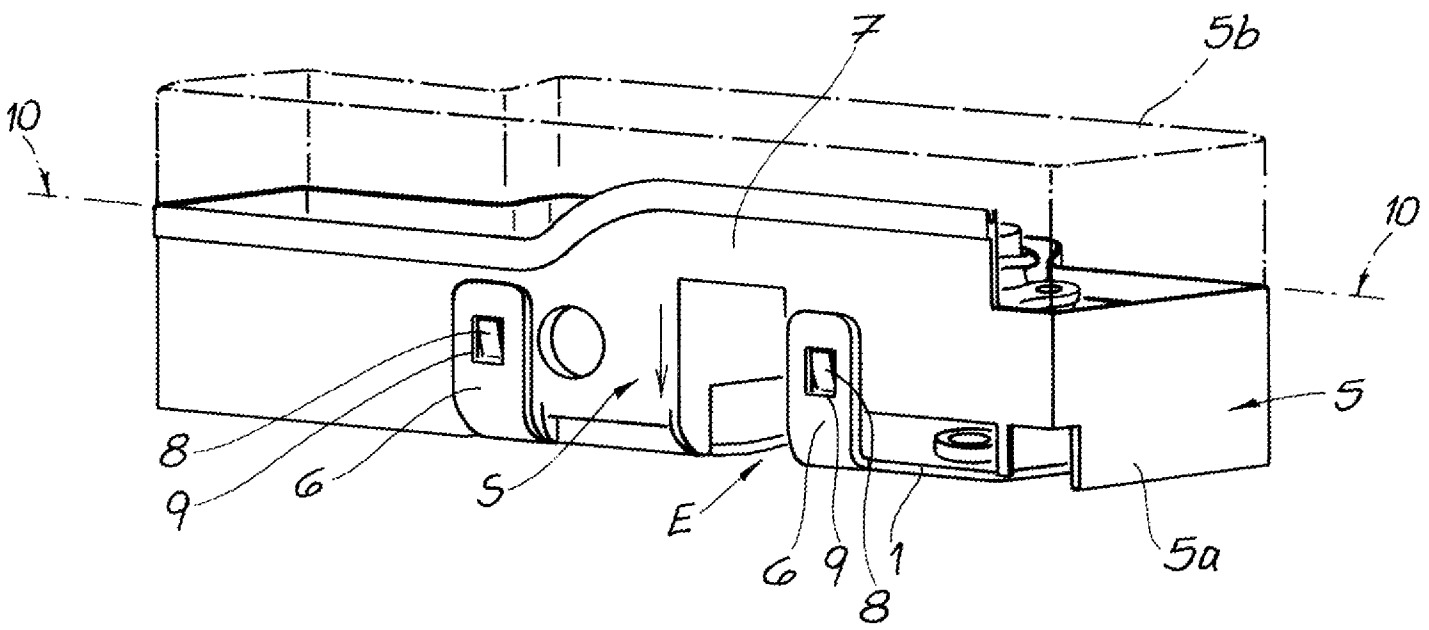

(51) Int. Cl.
*E05B 15/16* (2006.01)
*E05B 17/00* (2006.01)

(52) U.S. Cl.
CPC ... *E05B 17/0004* (2013.01); *E05B 2015/1664* (2013.01); *Y10S 292/23* (2013.01); *Y10S 292/53* (2013.01); *Y10S 292/54* (2013.01); *Y10T 292/108* (2015.04); *Y10T 292/1047* (2015.04); *Y10T 292/1082* (2015.04)

(58) Field of Classification Search
CPC ..... Y10T 292/108; Y10T 292/1082; Y10T 292/1047; Y10T 292/62; Y10S 292/23; Y10S 292/53; Y10S 292/54
USPC ..... 292/337, 200, 201, 216, DIG. 23, 292/DIG. 53, DIG. 54
See application file for complete search history.

(56) References Cited

U.S. PATENT DOCUMENTS 4,492,101 A * 1/1985 Tanaka ..... E05B 9/084 70/370
4,575,138 A 3/1986 Nakamura et al.
4,904,006 A * 2/1990 Hayakawa ..... E05B 81/06 292/201
5,000,495 A 3/1991 Wolfgang et al.
5,172,946 A * 12/1992 Dowling ..... E05B 83/16 292/216
5,431,460 A * 7/1995 Hass ..... E05B 15/04 292/216
5,520,424 A * 5/1996 Hapke ..... D06F 37/42 292/198
5,678,869 A * 10/1997 Yoshikuwa ..... E05B 81/66 292/216
5,855,130 A * 1/1999 Rorabacher ..... E05B 77/34 292/201
5,894,749 A * 4/1999 Tomaszewski ..... E05B 17/04 292/DIG. 43
5,899,508 A * 5/1999 Cetnar ..... E05B 81/16 292/216
5,961,163 A * 10/1999 Brackmann ..... E05B 81/06 292/201
6,014,876 A * 1/2000 Taylor ..... B60R 25/04 292/346
6,053,542 A * 4/2000 Ostrowski ..... E05B 81/20 292/201
6,102,453 A * 8/2000 Cetnar ..... E05B 77/28 292/199
6,109,674 A * 8/2000 Bartel ..... E05B 81/06 292/201
6,457,753 B1 * 10/2002 Wegge ..... E05B 81/54 292/216
6,497,436 B1 * 12/2002 DeBlock ..... E05B 81/06 292/201
6,698,805 B2 * 3/2004 Erices ..... E05B 77/04 292/201
6,733,052 B2 * 5/2004 Perkins ..... E05B 81/06 267/153
6,945,574 B2 * 9/2005 Hayakawa ..... E05B 81/06 292/201
6,951,355 B2 * 10/2005 Hayakawa ..... E05B 81/06 292/201
7,156,430 B2 * 1/2007 Hidding ..... E05B 85/02 292/216
7,500,700 B2 * 3/2009 Kunst ..... E05B 81/14 292/201
7,726,707 B2 * 6/2010 Simchayoff ..... E05B 85/26 292/216
9,140,037 B2 * 9/2015 Nagaoka ..... E05B 85/02
9,284,758 B2 * 3/2016 Yokomori ..... E05B 77/34
9,404,297 B2 * 8/2016 Bennett ..... E05C 5/00
9,982,468 B2 * 5/2018 Mittelbach ..... E05B 77/04
2014/0175813 A1 * 6/2014 Margheritti ..... E05B 85/26 292/201
2014/0203570 A1 * 7/2014 Nass ..... E05B 81/25 292/196

FOREIGN PATENT DOCUMENTS

DE 60012253 T2 9/2005
DE 20 2010 007353 U1 10/2011
DE 102012211898 A1 1/2013
EP 0 103 904 A2 3/1984
EP 0 331 832 A1 9/1989
FR 2512871 A1 3/1983
WO 2009056120 A2 5/2009

OTHER PUBLICATIONS

Search Report of DE Application No. 102014007525.7 dated Mar. 20, 2015.

* cited by examiner

MOTOR VEHICLE DOOR LOCK

The invention relates to a motor vehicle door latch, with a latch case, furthermore with at least one locking mechanism located in the latch case essentially comprising a catch and a pawl, and with a latch housing connected to the latch case, whereby the cross-section of the latch case is mainly L-shaped and describes a locking mechanism plane and a different front panel plane, and whereby the front panel plane is equipped with at least one bridging component spanning an infeed section and two lateral components.

Generally, such a motor vehicle door latch or such a motor vehicle door latch with a similar construction is housed inside or on a motor vehicle door. In the present case, it primarily involves so-called lateral door latches, i.e. motor vehicle door latches arranged inside a lateral door. In contrast, a locking bolt interacting with the motor vehicle door latch is connected to a chassis, for example to a B pillar of a motor vehicle chassis. The basic topological relationships and the interplay of the locking bolt with the locking mechanism essentially comprising a catch and a pawl is described in DE 32 34 103 C2.

Historically, the latch case has typically been designed as a solid body in order to be able to be in control of bending stresses and in particular of forces occurring during an impact. For example, DE 28 06 491 C2 works with an additional cover or a rotor lid for the catch there. Thus, the bolting system or locking mechanism should be protected from bending stresses and proper functioning of the motor vehicle door latch should be guaranteed in all circumstances.

Currently, one predominantly works with latch cases with an L-shaped cross section, as described, for example, in WO 2009/056 120 A2 of the applicant. Here a latch case predominantly with an L-shaped cross section is realised, which on the one hand describes the locking mechanism plane which mainly bears the locking mechanism and on the other hand the differentiated front panel plane. The locking mechanism plane corresponds to an L-leg of the latch case; in contrast the front panel plane represents the other L-leg of the latch case. As the motor vehicle door latch is essentially connected on the front panel plane to the pertaining motor vehicle door and, in particular, the lateral motor vehicle door, the front panel plane is subsequently spoken about which extends at an angle compared to the locking mechanism plane.

However, within the scope of the present invention, the term "front panel plane" is not be understood restrictively to mean that the relevant motor vehicle door latch is connected or needs to be connected to the pertaining motor vehicle door to or with the aid of this front panel plane. Instead, the term "front panel plane" expresses that a plane deviating from the locking mechanism plane is hereby involved which, compared to the L-leg pertaining to the locking mechanism plane, characterizes the other L-leg of the latch case with an L-shaped cross-section.

For a motor vehicle door latch of the construction described at the start according to DE 20 2010 007 353 U1, the latch case is connected to a lateral motor vehicle door with its front panel plane, namely to a front panel plane of the relevant motor vehicle lateral door. It is known that such a motor vehicle lateral door regularly possesses an external panel, an internal panel and the aforementioned front panel which connects the external panel to the internal panel.

Figure 2:
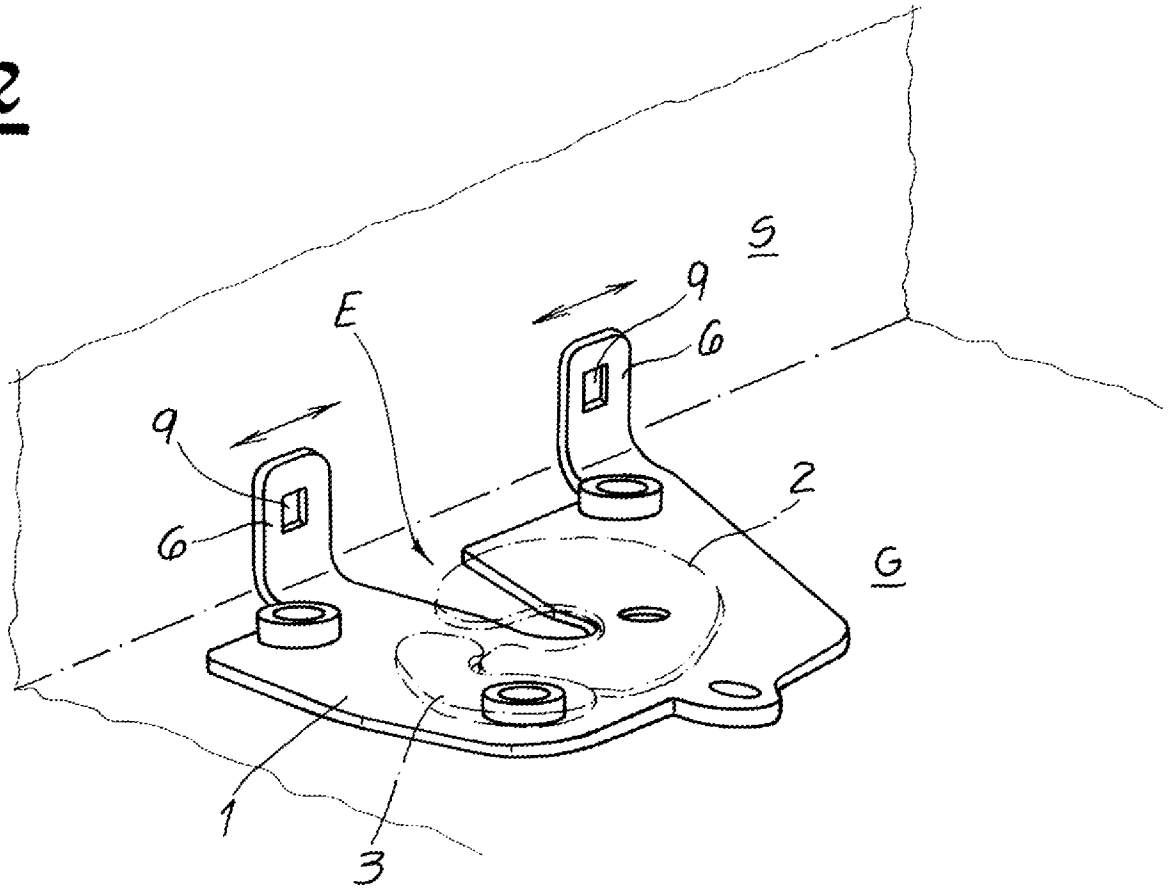

On the basis of FIG. 2 of the class-specific DE 20 2010 007 353 U1, it is clear that the latch case is equipped with two lateral components in the area of the infeed section or its front panel plane which border the intermediate infeed section. Furthermore, a bridging component is realised which connects the two lateral components. Thus, the known motor vehicle door latch is able to fulfill the requirements placed on such safety-related components.

In fact, tensile tests inter alia are undertaken in particular in crash investigations. Here, forces impact on the lateral door and thus the pertaining motor vehicle door latch which aim to simulate different accident situations. Despite these impacting tensile forces, the functionality of the locking mechanism should still be guaranteed. Because otherwise there is the risk of the pertaining motor vehicle door springing open in an uncontrolled manner, meaning that in particular the safety systems now found in such motor vehicle doors, such as lateral airbags, are unable to reliably produce their effects.

In order to control the aforementioned tensile forces in the safety test, the class-specific motor vehicle door latches in the area of the infeed section are equipped with the aforementioned bridging component in the front panel plane which spans the infeed section and it is regularly proceeded in such a way that the latch case encompasses the latch housing. This has been fundamentally proven to work.

Due to the increased use of safety systems, such as airbags, seatbelt tensioners, lateral impact protection, etc. and also the increased convenience requirements of the customers with regard to window lifters, electrical seat adjusters, electrical mirror adjusters, etc. the weight of even simple cars has constantly increased. However, at the same time a weight reduction is demanded to decrease consumption. According requirements are placed on all components and also on motor vehicle door latches. However, the weight reduction should not lead to a reduction in safety. This is where the invention is used.

The invention is based on the technical problem of further developing such a motor vehicle door latch in such a way that a weight-optimized design form is provided with simultaneous retention of the safety standard.

In order to solve this technical issue, a class-specific motor vehicle door latch within the scope of the invention is characterized in that the front panel plane of the latch case or the latch case itself is equipped solely with the two lateral components bordering the infeed section in a bridging component-free manner, whereas the latch housing functions either wholly or partially as a bridging substitute component or defines the bridging component. I.e. the front panel plane is still spanned by the latch case according to the invention, in the present case described by the two lateral sections. However, the bridging component also arranged in the front panel plane is also located on the latch housing or is defined hereon.

Within the scope of the invention, the latch case consequently dispenses with the bridging component between the two lateral components. I.e. the latch case which previously demonstrated two lateral components and the bridging component is reduced to the two lateral components according to the invention. An enormous weight saving is thus attained of up to 50%. The invention is typically based on the insight that the latch case is typically a steel component. The latch case is generally stamped and/or molded out of a metal sheet and in particular a steel metal sheet. Dispensing with the bridging component between the two lateral components now leads to the described significant weight reduction in view of the material used (steel).

At the same time, however, no reduced safety is observed. That is because the motor vehicle door latch according to the invention still absorbs the prescribed tensile forces during safety tests easily and the functionality of the locking mechanism is in particular guaranteed in an unchanged manner. In essence, this can be attributed to the fact that the function of the bridging component on the latch case according to the state of the art and according to the invention is undertaken wholly or partially by the latch housing—and consequently not the latch case. Consequently, the latch housing functions wholly or partially as a bridging substitute component or a bridging component in this regard.

Here, the invention is based on the insight that the tensile forces impacting the motor vehicle door latch in the case of an accident primarily impact the locking mechanism plane of the latch case and the two lateral components. In contrast, relatively small forces occur in the section of the bridging component on the latch case according to the state of the art which, according to the invention, can also be largely controlled by the plastic latch housing.

This applies all the more as the forces occurring here predominantly impinge the plastic of the latch housing in its lengthwise extension which, in this context, functions wholly or partially as a bridging substitute component or a bridging component. However, plastics are also relatively stiff in this regard. Consequently, the observed effect is explained. In contrast, in the section between the two lateral components bordering the infeed section on the front panel plane of the latch case, no or very few shear forces occur.

According to an advantageous design, the two lateral components of the latch case bordering the infeed section are respectively connected to the latch housing. The section connecting the two lateral components of the latch case with one another functions as a bridging component substitute section or as a bridging component.

To enable perfect force transmission to occur here, the latch housing is advantageously connected undetachably to the two lateral components of the latch case. The undetachable connection can be configured as a clip connection in this context. For this purpose, the two lateral components usually have an aperture respectively. A bridge and, in particular, a clip bridge engages into the aperture. The bridge or clip bridge is provided for on the latch housing. In contrast, the aperture is observed in the lateral component on the latch case.

It has been proven when the latch housing is formed in two parts overall with an upper and lower shell. Thus, the stiffness of the latch housing can be increased with respect to the bending stresses. This also facilitates assembly. In this context, it is furthermore provided for that the lower shell of the latch housing connects the two lateral components of the latch case and, in this regard, demonstrates the bridging component substitute section or the bridging component.

Furthermore, the configuration is usually such that the lower shell describes a dividing plane. In contrast to this dividing plane, the bridging component substitute section or the bridging component is raised on the lower shell. As already explained at the start, the latch case is usually made of steel. The latch case is typically a steel sheet component which is stamped and/or molded. The design of the latch case is such that it at least partially encompasses the latch housing. The latch housing is made of plastic. It generally is an injection-molded plastic component.

As a result, a motor vehicle door latch is provided which fulfills specifications with retention of the safety standards in particular with regard to tensile tests or accident safety; however, it demonstrates a significant weight saving at the same time. In essence, this can be attributed to the robust latch case being of a bridging component-free design. I.e. the latch case or its front panel plane are practically (still) described by the two lateral components bordering the infeed section. In contrast, the robust bridging component molded from steel in the latch case has proven to be dispensable.

The invention attains this in essence by the function of the bridging component of the steel latch case being assumed and also being able to be assumed by the latch housing made of plastic. In fact, in this context the latch housing functions wholly or partially as a bridging substitute component or defines the bridging component. As the latch housing in the area of the bridging component on the latch case was already present consistently according to the state of the art, the bridging component on the latch case can be eliminated without substitute according to the invention. The section of the latch housing provided for here according to the state of the art also functions in contrast and according to the invention as a bridging substitute component or bridging component.

In conjunction with the undetachable connection of the two lateral components with the latch housing, any forces impacting the lateral components can be transferred to the latch housing and absorbed by it. The clip connection advantageously provided for in this section between the lateral component and the latch housing ensures this.

Only a slight modification of the conventional latch housing is necessary to execute the clip connection in such a way that the latch housing is equipped with a molded bridge, for example, and in particular a clip bridge in each instance in the area of the pertaining aperture of the lateral component. As soon as the latch housing is clipped to the two lateral components by engagement of the relevant bridges or clip bridges into the apertures of the corresponding lateral components, the latch housing and the latch case encompassing the latch housing almost form a constructional unit which fulfils the necessary safety specifications overall and according to the invention, also without the bridging component between the two lateral components absent on the latch case. An enormous weight saving is thus attained which was previously not thought possible. This all succeeds without having a negative impact on safety. These are the crucial advantages.

Hereinafter, the invention is explained in further detail on the basis of a sketch which only depicts an execution example. It shows:

FIG. 1 the motor vehicle door latch according to the invention in one aspect and FIG. 2 the latch case in detail.

A motor vehicle door latch is depicted in the figures. In the present case, the motor vehicle door latch is not restrictedly a motor vehicle lateral door latch. The relevant motor vehicle door latch is consequently attached inside a motor vehicle door and in particular a motor vehicle lateral door. A locking bolt arranged on a pertaining motor vehicle chassis interacts with the depicted motor vehicle door latch. The locking bolt is usually located on a B pillar or a C pillar of the relevant motor vehicle chassis.

The motor vehicle door latch is regularly attached to a front panel and/or an internal panel of the motor vehicle door. As is known, the front panel of a motor vehicle door or a motor vehicle lateral door connects an external panel to an internal panel. In principle, attachment to the external panel is naturally also conceivable. However, the reproduced motor vehicle door latch is generally fixed on the front panel and/or internal panel of the relevant motor vehicle door. The front panel of the motor vehicle door essentially runs on the same plane as the plane of the motor vehicle door latch depicted in one aspect in FIG. 1.

The motor vehicle door latch as such essentially comprises a latch case 1 and a locking mechanism 2, 3 located in the latch case 1. The locking mechanism 2, 3 is only depicted in FIG. 2 and comprises a catch 2 and a pawl 3. A latch housing 5 which is connected to the latch case 1 belongs to the further fundamental construction.

The latch case 1 mainly has an L-shaped cross-section. In fact, the latch case 1 describes a locking mechanism plane G which is best recognized in FIG. 2 and a front panel plane S different therefrom. The front panel plane S of the L-shaped latch case 1 essentially coincides with the plane spanned by the front panel of the motor vehicle door or is arranged parallel to this, as clarified in a comparison of FIGS. 1 and 2.

In the front panel plane S one recognizes an infeed section E, via which the locking bolt attached to the B-pillar in the example enters the depicted motor vehicle door latch and can then interact with the locking mechanism 2, 3. On the basis of FIG. 1, it is recognized that the front panel plane S is equipped with at least a bridging component 7 spanning the infeed section E and two lateral components 6.

Both lateral components 6 border the infeed section E. i.e. the infeed section E is arranged between the two lateral components 6. According to the invention and of special significance is now the circumstance that the front plate plane S of the latch case 1 or the latch case 1 as such is of a bridging component-free design and has only the two lateral components 6 bordering the infeed section E. In other words, the front panel plane S is only spanned by the two lateral components 6 of the latch case 1 according to the invention. In contrast, a bridging component 7 of the latch case 1 compulsorily realised according to the state of the art which previously connected the two lateral components 6 is absent.

In fact, the latch housing 5 assumes the function of this bridging component 7 within the scope of the invention. I.e. the latch housing 5 functions wholly or partially as a bridging substitute component or defines the bridging component 7. The bridging component 7 is still arranged in the front panel plane S.

For this purpose, the two lateral components 6 are connected to the latch housing 5. Thus, a section 7 of the latch housing 5 connecting the two lateral components 6 of the latch case 1 can function as a bridging component substitute section or as a bridging component 7.

In order that the bridging component substitute section or the bridging component 7 fulfills and can also fulfill its described function as a component of the latch housing 5, the latch housing 5 is undetachably connected with the two lateral components 6 in the design example. In the present case, a clip connection 8, 9 is executed for the undetachable connection of the two lateral components 6 with the latch housing 5. The clip connection 8, 9 in the design example comprises an aperture 9 in the respective lateral component 6 and a bridge 8 respectively engaging into the aperture 9. The bridge 8 is a clip bridge 8 which is arranged on the latch housing 5 and within the scope of the design example is molded to the latch housing 5.

It is recognized on the basis of a comparative view of FIGS. 1 and 2 that the cross-section of the bridge or clip bridge 8 molded on the latch housing 5 is triangular, in such a way that the bridge or clip bridge 8 forms a leg which protrudes almost vertically from the latch case 5. This protruding leg and a bevel connected to it define the bridge or clip bridge 8 in its lengthwise extension. In fact, the bridge 8 demonstrates a shape which is rectangular in the top view. The aperture 9 is equipped with a rectangular shape adapted to the rectangular shape of the bridge 8.

The bevel executed by the bridge or the clip bridge 8 allows the latch case 5 to be connected with the latch case 1 in the mounting direction depicted by an arrow in FIG. 1 in such a way that initially the bevel glides along the lateral component 6 and the bridge 8 with its leg essentially protruding vertically opposite the latch housing 5 reaching behind an upper edge of the aperture 9. Thus, the clip connection 8, 9 is produced and the latch case 1 is undetachably connected to the latch housing 5.

In the design example, the latch housing 5 comprises a lower shell 5*a* depicted in FIG. 1 and an upper shell 5*b* only depicted in FIG. 1. The configuration is such that the latch case 1 is undetachably connected to the lower shell 5*a* of the latch housing 5, namely in the design example with the aid of the clip connection 8, 9, as already described. The upper shell 5*b* is then connected to the constructional unit consisting of the latch case 1 and the lower shell 5*a*. This can be made again via non-depicted clip connections or screw connections or however else, whereby simultaneously a seal to be inserted between the lower shell 5*a* and the upper shell 5*b* ensures a media-tight sealing of the latch housing 5.

The lower shell 5 demonstrates the bridging component substitute section or the bridging component 7 which connects the two lateral components 6 of the latch case 1. With the aid of the bridging component substitute section or the bridging component 7 as a component of the latch housing 5 or the lower shell 5*a* any movements of the lateral components 6 against one another are intercepted in a crash or a safety test simulating a crash and the two lateral components 6 are stiffened together in a bridge-like manner. To this end, conceivable deformities are depicted in FIG. 2 by double arrows in each instance. According to the invention, the deformities predominantly correspond to an impingement of the latch housing 5 in its lengthwise extension. Particular stiffness is observed in this regard. The circumstance that the lower shell 5*a* as a component of the latch housing 5 generally describes a dividing plane 10 with the opposite elevated bridging component substitute section or the bridging component 7 also contributes to this.

The latch case 1 is typically made of steel. This is usually a sheet metal component made of steel which is stamped and L-shaped as depicted. In contrast, the latch housing 5 is made of plastic. It has been proven here when the latch housing 5 is configured as an injection-molded plastic component. This applies namely for both the lower shell 5*a* and the upper shell 5*b*.

The invention claimed is:

1. A motor vehicle door latch comprising:

a latch case;

at least one locking mechanism located in the latch case and essentially comprising a catch and a pawl; and a latch housing connected with the latch case, wherein the latch case has an L-shaped cross-section and defines a locking mechanism plane and a front panel plane different therefrom, wherein the front panel plane is defined by a bridging component spanning two lateral components of the latch case and an infeed section defined by an area between the two lateral components with the infeed section being open from the area defined between the two lateral components to past a length of the two lateral components extending along the front panel plane, wherein the latch case is configured in a bridging component-free manner without the latch case having any bridging part that connects the two lateral components along the front panel plane, with solely the two lateral components bordering the infeed section, and wherein the latch housing wholly or partially defines the bridging component that bounds the infeed section between the two lateral components, wherein during an impact on the motor vehicle door latch, the bridging component of the latch housing is configured to absorb forces occurring during the impact whereby a shear force occurring in the area between the two lateral components bordering the infeed section on the front panel plane is reduced or eliminated.

2. The motor vehicle door latch according to claim 1, wherein the two lateral components are connected to the latch housing.

3. The motor vehicle door latch according to claim 2, wherein a section of the latch housing connecting the two lateral components of the latch case functions as the bridging component.

4. The motor vehicle door latch according to claim 1, wherein the latch housing is undetachably connected to the two lateral components of the latch case.

5. The motor vehicle door latch according to claim 4, wherein a clip connection is provided for an undetachable connection between the latch housing and the two lateral components.

6. The motor vehicle door latch according to claim 1, wherein the two lateral components are respectively equipped with an aperture for a clip bridge on the latch housing.

7. The motor vehicle door latch according to claim 1, wherein the latch housing is configured as two components with a lower shell and an upper shell.

8. The motor vehicle door latch according to claim 7, wherein the lower shell of the latch housing connects the two lateral components of the latch case and has the bridging component.

9. The motor vehicle door latch according to claim 8, wherein the lower shell defines a dividing plane with the bridging component elevated in contrast.

10. The motor vehicle door latch according to claim 1, wherein the latch case is made of steel, while the latch housing is made of plastic.

* * * * *